US007644737B2

(12) United States Patent
Mueller

(10) Patent No.: US 7,644,737 B2
(45) Date of Patent: Jan. 12, 2010

(54) METHOD FOR PRODUCTION OF A VELVET RIBBON WITH DOUBLE-SIDED NAP AND RIBBON WEAVING MACHINE FOR CARRYING OUT SAID METHOD

(75) Inventor: Martin Mueller, Möhlin (CH)

(73) Assignee: Textilma AG (CH)

( * ) Notice: Subject to any disclaimer, the term of this patent is extended or adjusted under 35 U.S.C. 154(b) by 106 days.

(21) Appl. No.: 11/990,459

(22) PCT Filed: Mar. 9, 2006

(86) PCT No.: PCT/CH2006/000144

§ 371 (c)(1),
(2), (4) Date: Feb. 14, 2008

(87) PCT Pub. No.: WO2007/025394

PCT Pub. Date: Mar. 8, 2007

(65) Prior Publication Data

US 2008/0230138 A1 Sep. 25, 2008

(30) Foreign Application Priority Data

Sep. 2, 2005 (CH) ..... 1431/05

(51) Int. Cl.

| | |
|---|---|
| ***D03D 27/10*** | (2006.01) |
| ***D03D 39/16*** | (2006.01) |
| ***D03D 39/18*** | (2006.01) |
| *D03D 41/00* | (2006.01) |

(52) U.S. Cl. ..... 139/21; 139/11; 139/20; 139/23; 139/43; 139/398

(58) Field of Classification Search ..... 139/11, 139/20, 21, 22, 23, 43, 291 C, 391, 397, 398, 139/403, 405, 407, 408, 418, 411
See application file for complete search history.

(56) References Cited

U.S. PATENT DOCUMENTS 1,846,245 A * 2/1932 Bishop ..... 139/397

(Continued)

FOREIGN PATENT DOCUMENTS

CH 554 431 A 9/1974

(Continued)

*Primary Examiner*—Bobby H Muromoto, Jr.
(74) *Attorney, Agent, or Firm*—George Pappas

(57) ABSTRACT

A velvet ribbon with double-sided nap is produced by weaving three superimposed webs (8, 10, 12) connected to each other by nap threads (14). The nap threads (14) of the above triple web are separated between the middle web (8) and a first web (10) in a first cutting device (36, 36*a*). In a second cutting device (46, 46*a*) the nap threads between the middle web (8) and the second web (12) are separated to give the middle web as a double-sided velvet ribbon (8). The corresponding ribbon weaving machine (2) comprises three superimposed weaving points (31) each with a weft introduction body and a common shedding device (16). A first cutting device (36) for cutting the nap threads (14*a*) between the middle web (8) and a first web (12) and a second cutting device (46) for cutting the nap threads (14*b*) between the middle web (8) and the second web (10) are provided afterwards. The velvet ribbon (8) produced thus has a nap (56, 58) on both sides.

20 Claims, 4 Drawing Sheets

U.S. PATENT DOCUMENTS

| | | | | | |
|---|---|---|---|---|---|
| 2,329,738 | A | * | 9/1943 | Baker | 139/398 |
| 2,333,258 | A | * | 11/1943 | Lambert | 28/159 |
| 2,391,835 | A | * | 12/1945 | Kavanagh | 139/21 |
| 2,735,452 | A | * | 2/1956 | Hellebrekers | 139/397 |
| 2,866,255 | A | * | 12/1958 | Keen | 428/89 |
| 3,013,325 | A | * | 12/1961 | McNally et al. | 28/160 |
| 3,014,502 | A | * | 12/1961 | Valentine | 139/21 |
| 3,066,380 | A | * | 12/1962 | McNally et al. | 428/88 |
| 3,204,669 | A | * | 9/1965 | Valentine | 139/46 |
| 3,289,706 | A | * | 12/1966 | Valentine | 139/21 |
| 3,499,471 | A | * | 3/1970 | Kuny | 139/21 |
| 3,519,032 | A | * | 7/1970 | Sabbe | 139/398 |
| 3,993,105 | A | | 11/1976 | Diesner | |
| 4,024,003 | A | | 5/1977 | Buhler | |
| 4,039,008 | A | | 8/1977 | Diesner | |
| 4,057,083 | A | * | 11/1977 | Juillard et al. | 139/20 |
| 4,456,035 | A | * | 6/1984 | Bruggemann et al. | 139/398 |
| 4,561,473 | A | * | 12/1985 | Yonehana et al. | 139/21 |
| 4,667,703 | A | * | 5/1987 | Sakai et al. | 139/20 |
| 4,756,340 | A | * | 7/1988 | Janssen | 139/397 |
| 5,380,561 | A | * | 1/1995 | Dorn | 427/430.1 |
| 5,400,831 | A | * | 3/1995 | Gheysen | 139/21 |
| 5,615,712 | A | * | 4/1997 | Derudder et al. | 139/21 |
| 5,655,573 | A | * | 8/1997 | Gheysen et al. | 139/21 |
| 6,305,431 | B1 | * | 10/2001 | Fenkes | 139/391 |
| 6,336,475 | B2 | * | 1/2002 | Dewispelaere et al. | 139/391 |
| 6,817,383 | B2 | * | 11/2004 | Debaes et al. | 139/21 |
| 6,837,274 | B2 | * | 1/2005 | Debaes et al. | 139/21 |
| 6,923,219 | B2 | * | 8/2005 | Shteiyer | 139/397 |
| 7,086,424 | B2 | * | 8/2006 | Debaes et al. | 139/418 |
| 2004/0200539 | A1 | * | 10/2004 | Shteiyer | 139/391 |

FOREIGN PATENT DOCUMENTS

| | | | |
|---|---|---|---|
| CH | 619 009 | A5 | 8/1980 |
| DE | 1 883 797 | U | 11/1963 |
| DE | 1 710 282 | A1 | 10/1971 |
| DE | 2 407 550 | A1 | 9/1974 |
| DE | 25 30 191 | A1 | 5/1976 |
| DE | 25 48 063 | A1 | 5/1976 |
| DE | 37 37 999 | A1 | 6/1988 |
| DE | 41 03 443 | A1 | 8/1992 |
| EP | 0 964 090 | A2 | 12/1999 |
| EP | 1 375 714 | A1 | 1/2004 |
| EP | 1 375 715 | A1 | 1/2004 |
| GB | 1 470 690 | A | 4/1977 |
| GB | 2 115 022 | A | 9/1983 |

* cited by examiner

METHOD FOR PRODUCTION OF A VELVET RIBBON WITH DOUBLE-SIDED NAP AND RIBBON WEAVING MACHINE FOR CARRYING OUT SAID METHOD

This application claims priority of PCT application PCT/CH2006/000144 having a priority date of Sep. 2, 2005, the disclosure of which is incorporated herein by reference.

TECHNICAL FIELD

The invention relates to a method for the production of a velvet ribbon with a double-sided nap, a ribbon weaving machine for carrying out said method, and a velvet ribbon thus produced.

BACKGROUND OF THE INVENTION

It is known from CH 554 431 to produce velvet ribbons on a shuttleless ribbon weaving machine, two webs being produced which lie one above the other at a distance and are connected to one another by means of nap threads. The nap threads are severed at half the distance between the individual webs, and two velvet ribbons having a nap on the one side are obtained. The publication contains no indications as to the possibility of producing a double-sided velvet ribbon.

SUMMARY OF THE INVENTION

The object of the invention is to specify a method for production of a double-sided velvet ribbon and a ribbon weaving machine for carrying out such a method and also to provide a double-sided velvet ribbon produced according to the method and on the ribbon weaving machine.

The object is achieved, according to the invention, by means of:

a) a method for production of a velvet ribbon;

b) a ribbon weaving machine for carrying out said method; and c) a velvet ribbon.

Since three webs lying one above the other at a distance from one another are woven and are connected to one another by means of nap threads, a middle web, which has nap threads on both sides and an upper and a lower web, in each case provided with a nap on one side only, are obtained. First, at a first cutting device, the nap threads are cut through between the middle web and a first web, and then, at a second cutting device, the nap threads are severed between the middle web and the second web. The middle web then provides the desired two-sided velvet ribbon, while the upper and the lower web are discharged as waste.

Various methods are suitable for production; a particularly advantageous method is where the triple web is produced on a needle ribbon weaving machine. It is conceivable for the triple web to be further processed independently of the ribbon weaving machine; it is more advantageous, however, if the cutting of the nap threads is carried out immediately after weaving on the ribbon weaving machine. It is basically possible to carry out the cutting of the nap threads by means of two cutting devices which are independent of one another and which are arranged in succession. It is more advantageous if the first and the second cutting device are arranged next to one another, the web, once cut, having to be returned from the first cutting device to the second cutting device. This makes it possible to have a simple and particularly short form of construction of the cutting device.

The ribbon weaving machine for production of the ribbon has three weaving stations lying one above the other and at a distance from one another, each with a weft insertion member and a shedding device for opening three sheds and for laying nap threads connecting the weaving stations. The weaving stations are followed by a first cutting device for cutting the nap threads between the middle web and a first web and by a second cutting device for cutting the nap threads between the middle web and the second web.

In order to make it possible to cut the nap threads exactly to a specific nap height, it is advantageous if guides for the web, which are adjustable in the level and/or in the distance from one another, are arranged in each case at the cutting devices.

A ribbon weaving machine is particularly advantageous, the first and the second cutting device being arranged next to one another, and the first cutting device being assigned deflection means for returning the web to the second cutting device. This makes it possible to assign a common cutting member to both cutting devices. In this case, the cutting member may be designed as a cutting knife driven back and forth. A cutting member which is designed as a rotating cutting band is also possible. Expediently, the cutting members are assigned a grinding device, as is known from CH 554 431.

The cutting devices are assigned in each case a discharge device for discharging the separated web which, as a rule, is removed as waste.

Various ribbon weaving machines are suitable for carrying out the method, but, a needle ribbon weaving machine with three weft insertion needles arranged one above the other is particularly advantageous.

The novel double-sided velvet ribbon produced makes it possible to have novel and improved applications.

BRIEF DESCRIPTION OF THE DRAWINGS

Exemplary embodiments of the invention are described in more detail below with reference to diagrammatic drawings in which.

DETAILED DESCRIPTION OF THE PREFERRED EMBODIMENTS

Figure 1:
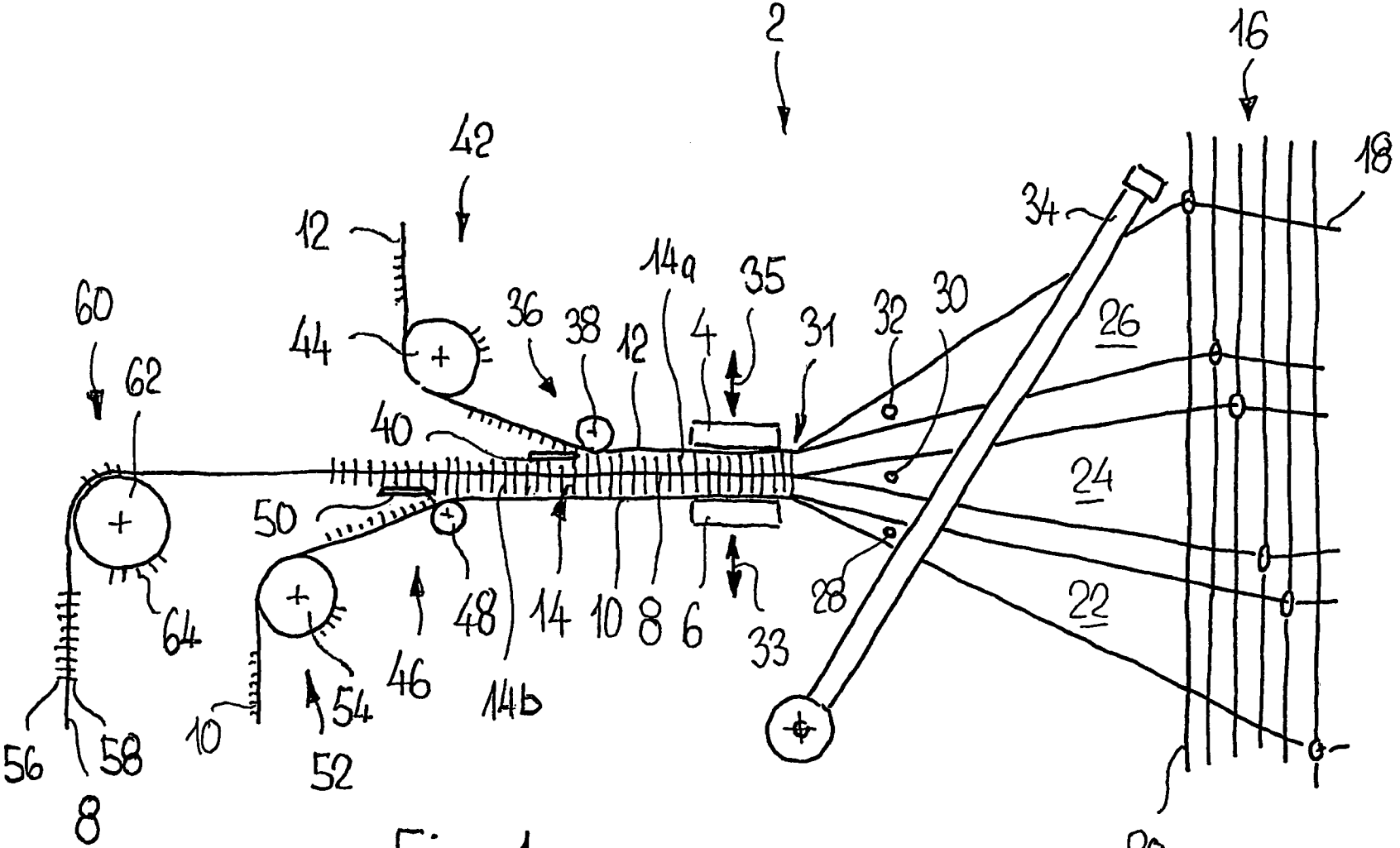
FIG. 1 shows a side view of a first ribbon weaving machine for producing a double-sided velvet ribbon.

FIG. 1 shows a ribbon weaving machine 2, in which, between an upper guide plate 4 and a lower guide plate 6, a middle web 8, a lower web 10 and an upper web 12 are produced which are connected to one another by means of nap threads 14 running transversely with respect to the web plane. For this purpose, in a shedding device 16, the warp threads 18 are guided by means of heddles 20 such that three sheds 22, 24 and 26 are obtained, into which weft threads 28, and 32 are inserted in each case. The weft threads are expediently inserted by means of weft needles, not illustrated in any more detail, of a ribbon weaving machine, the weft needles being arranged one above the other according to the weft threads 28, 30 and 32 to be supplied and jointly taking effect simultaneously. The weft threads 28, 30 and 32 are beaten up by means of a reed 34 at the three weaving stations 31 lying one above the other. By the distance between the guide plates 4, 6 being varied by means of actuating devices 33, 35 indicated diagrammatically, the distance between the webs 8, 10 and 12 and consequently the height of the nap threads 14 can be adjusted.

The weaving stations 31 are followed by a first cutting device 36 having a guide 38 and a cutting member 40 which severs the nap threads 14*a* between the middle web 8 and the upper web 12. The upper web 12 is discharged as waste by means of a discharge device 42 which has a needle roller 44. The first cutting device 36 is followed by a second lower cutting device 46 which likewise has a guide 48 and a cutting member 50. It severs the nap threads 14*b* between the middle web 8 and the lower web 10. The lower web 10 is discharged as waste by means of a discharge device 52 which again has a needle roller 54. The remaining middle web 8 has a two-sided nap 56, 58 and is discharged via a discharge device 60. This, too, preferably has a needle roller 62 which is fitted with needles 64 for the reliable discharge of the velvet ribbon 8 produced.

Figure 2:
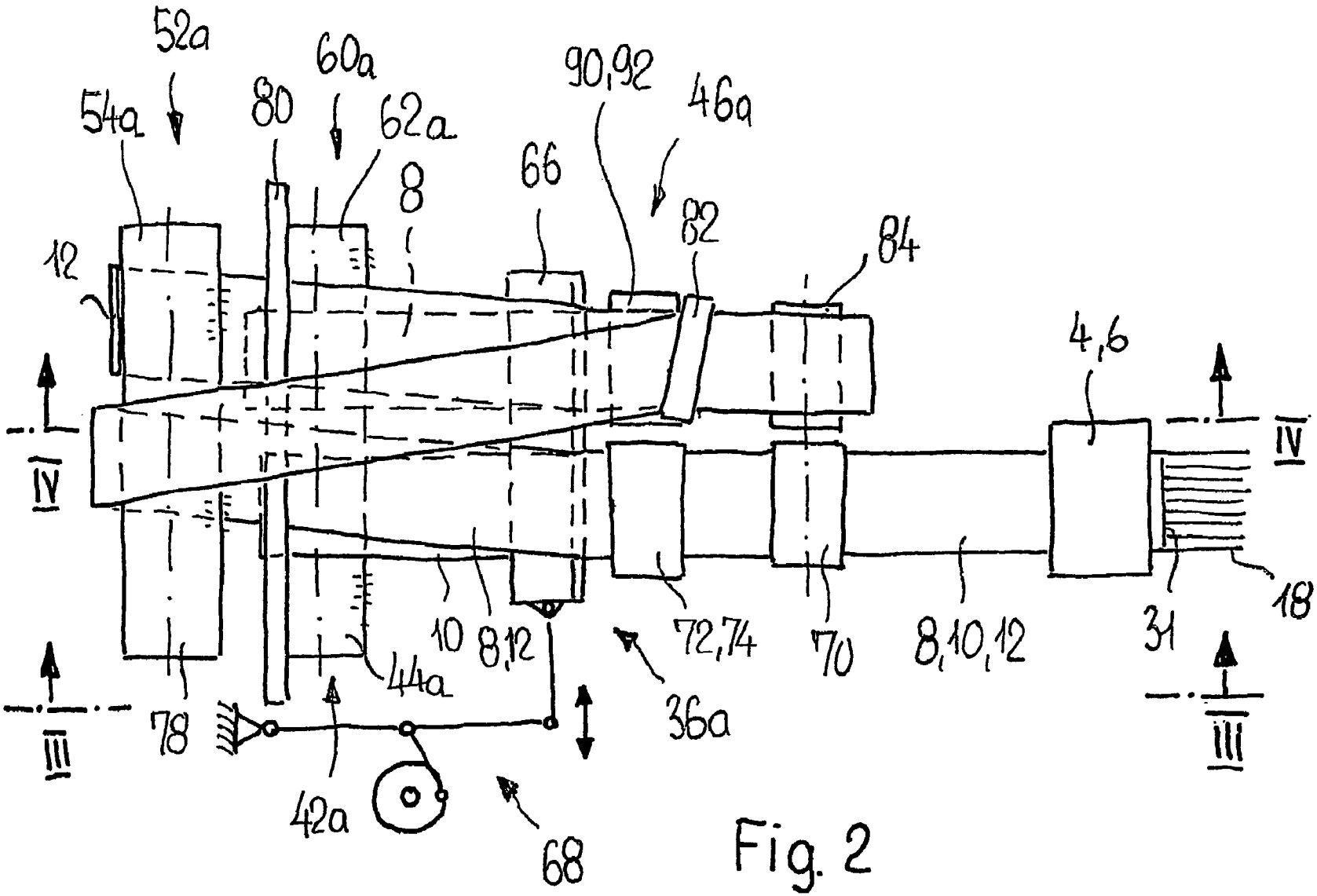
FIG. 2 shows a top view of a second ribbon weaving machine for producing a double-sided velvet ribbon.
Figure 3:
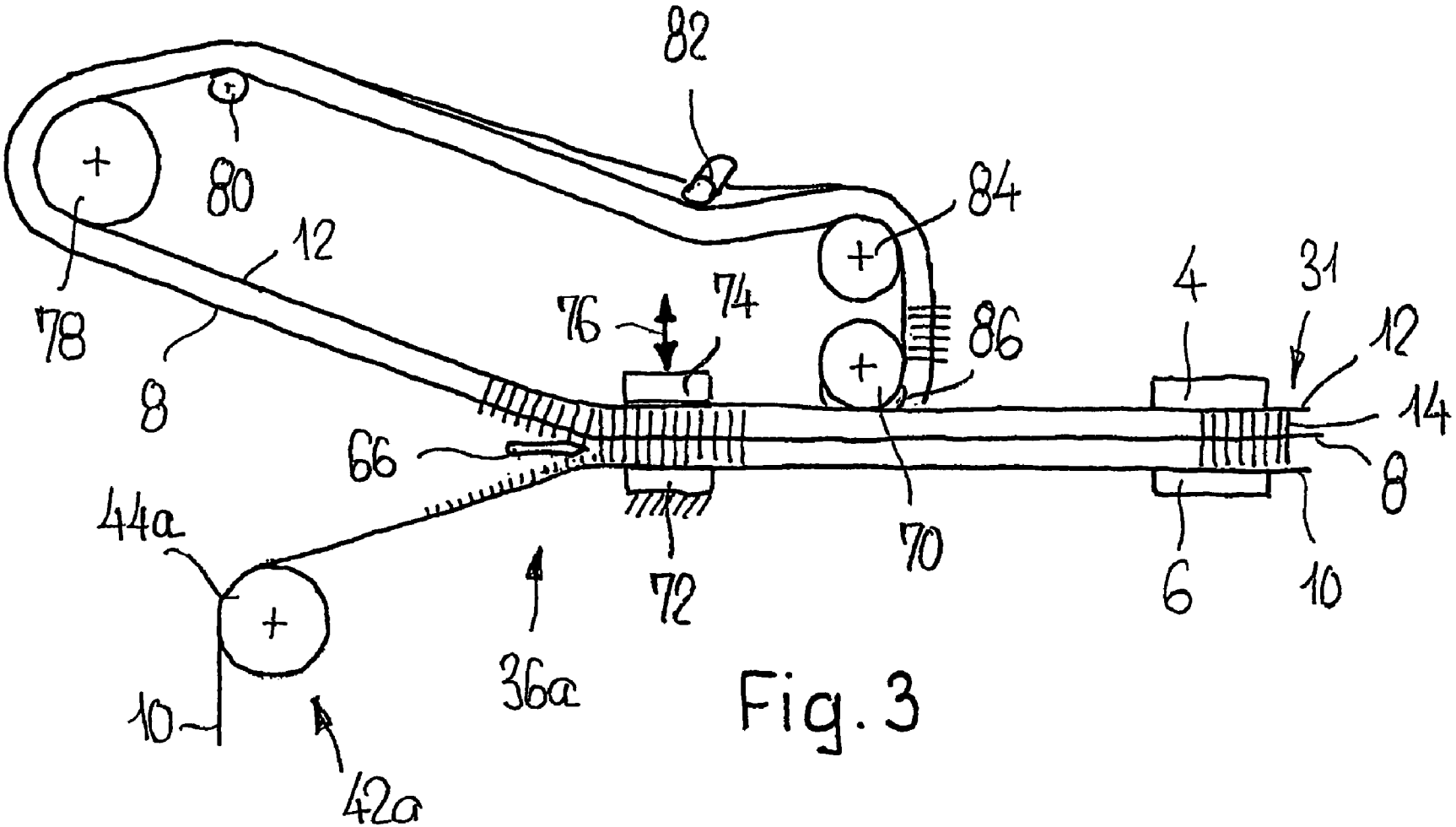
FIG. 3 shows the ribbon weaving machine of FIG. 2 in the view III-III of FIG. 2.
Figure 4:
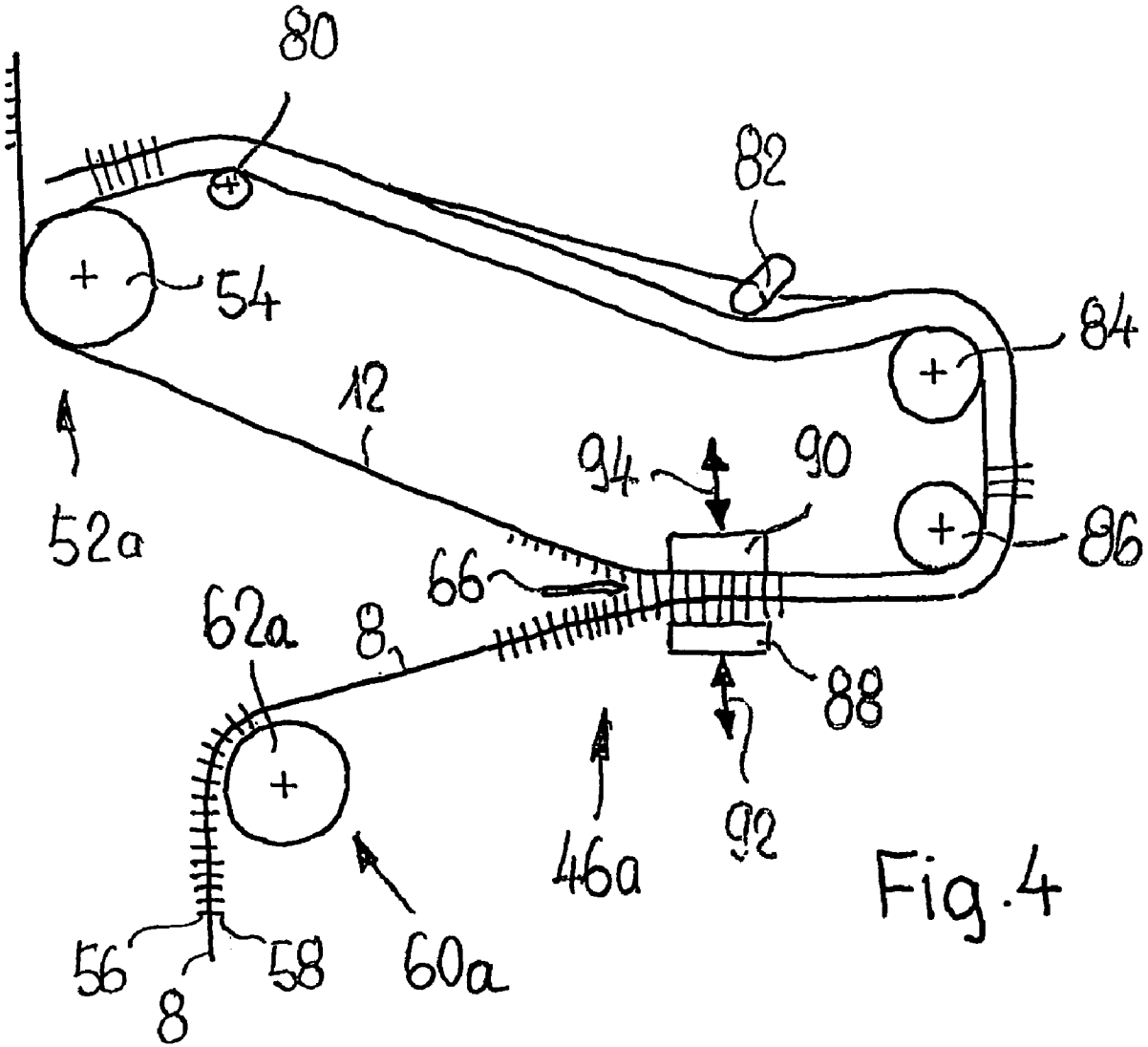
FIG. 4 shows the ribbon weaving machine of FIG. 2 in the view IV-IV of FIG. 2.

FIGS. 2 to 4 show a further ribbon weaving machine which, in principle, is constructed correspondingly to the first ribbon weaving machine of FIG. 1, and therefore identical parts are given the same reference symbols. In contrast to the ribbon weaving machine of FIG. 1, in the ribbon weaving machine of FIGS. 2 to 4 the cutting devices 36*a*, 46*a* are not arranged independently of one another, but next to one another, and have a common cutting member 66 which is designed as a knife and is driven back and forth by means of a drive 68.

The triple web 8, 10, 12, from the weaving station 31 is supplied, downstream of a first guide 70, to a first cutting device 36*a* which has two guide plates 72, 74. The lower guide plate 72 is fixed and the upper guide plate 74 is adjustable in its distance from the lower guide plate 72 by means of an actuating device 76 indicated. At the first cutting device 36*a*, the cut-off lower web 10 is discharged downward by means of a discharge device 42*a* and a corresponding needle roller 44*a*.

The middle web 8, with the upper web 12 lying above it, is supplied, offset laterally, to a first deflecting roller 78 which is designed as a needle roller and which deflects it rearward and, further, is supplied, offset laterally, via a first fixed guide 80 to a second straightening guide 82, at which it is deflected until it is oriented parallel to the triple web 8, 10, 12. It is supplied via two further deflecting rollers 84, 86 to the second cutting device 46*a*. This has, in turn, a lower guide plate 88 and an upper guide plate 90 which are adjustable in height and/or in the distance between one another by means of actuating devices 92, 94 indicated. In particular, the lower guide plate 88 of the second cutting device 46*a* must be set with respect to the guide plates 72 of the first cutting device at a height such that the middle web 8 has the same nap height on both sides, since the same cutting member 66 is used for both cutting devices 36*a*, 46*a*, but the thickness of the webs including the nap height, is different. At the second cutting device 46*a*, the upper web 12 is separated from the middle web 8. The upper web 12, in turn, is removed as waste by the discharge device 52*a* having the needle roller 54*a*. The middle web 8 is discharged as a double-sided velvet ribbon, with a nap 56, 58 on both sides, by means of a discharge device 60 which again contains a needle roller 62.

In the present exemplary embodiment, the deflecting roller 78 of the deflection device and the needle roller 54*a* of the discharge device 52*a* are formed in one piece. The needle roller 44*a* of the discharge device 42*a* is likewise in one piece with the needle roller 62*a* of the discharge device 60*a*.

The needle rollers illustrated may individually or all be replaced by other rollers having surfaces with a sufficiently good grip, such as, for example, those which have a roughened surface or are provided with a rubber clothing.

The upper or lower webs which, as a rule, are discharged as waste may, if appropriate, also be used as one-sided velvet ribbons.

| List of reference symbols | |
|---|---|
| 2 | Ribbon weaving machine |
| 4 | Upper guide plate |
| 6 | Lower guide plate |
| 8 | Middle web |
| 10 | Lower web |
| 12 | Upper web |
| 14 | Nap thread |
| 14a | Nap thread |
| 14b | Nap thread |
| 16 | Shedding device |
| 18 | Warp threads |
| 20 | Heddles |
| 22 | Shed |
| 24 | Shed |
| 26 | Shed |
| 28 | Weft thread |
| 30 | Weft thread |
| 31 | Weaving station |
| 32 | Weft thread |
| 33 | Actuating device |
| 34 | Reed |
| 35 | Actuating device |
| 36 | First cutting device |
| 36a | First cutting device |
| 38 | Guide |
| 40 | Cutting member |
| 42 | Discharge device |
| 42a | Discharge device |
| 44 | Needle roller |
| 44a | Needle roller |
| 46 | Second cutting device |
| 46a | Second cutting device |
| 48 | Guide |
| 50 | Cutting member |
| 52 | Discharge device |
| 52a | Discharge device |
| 54 | Needle roller |
| 54a | Needle roller |
| 56 | Nap |
| 58 | Nap |
| 60 | Discharge device |
| 62 | Needle roller |
| 66 | Cutting member |
| 68 | Drive |
| 70 | Guide |
| 72 | Lower guide plate |
| 74 | Upper guide plate |
| 76 | Actuating device |
| 78 | Deflecting roller |
| 80 | Fixed guide |
| 82 | Straightening guide |
| 84 | Deflecting roller |
| 86 | Deflecting roller |
| 88 | Lower guide plate |
| 90 | Upper guide plate |
| 92 | Actuating device |
| 94 | Actuating device |

The invention claimed is:

1. A method for production of a velvet ribbon which has a nap on both sides, characterized by weaving and connecting three webs lying one above the other at a distance from one another to one another by means of nap threads, first severing the nap threads of the triple web thus produced in a first cutting device between the middle web and a first web, and then severing, in a second cutting device, the nap threads between the middle web and the second web in order thereby to obtain the middle web as a two-sided velvet ribbon.

2. The method as claimed in claim 1, characterized in that the triple web is produced on a needle ribbon weaving machine.

3. The method as claimed in claim 1, characterized in that the cutting of the nap threads is carried out immediately after weaving on a ribbon weaving machine.

4. The method as claimed in claim 1, characterized in that the first and the second cutting device are arranged next to one another, and the web, once cut, is returned from the first cutting device to the second cutting device.

5. A ribbon weaving machine characterized in that it has three weaving stations lying one above the other and at a distance from one another, each with a weft insertion member and a common shedding device for opening three sheds and for laying nap threads connecting the weaving stations, wherein, in operation of the weaving machine, three webs lying one above the other at a distance from one another are woven and are connected to one another by means of nap threads, in that the weaving stations are followed by a first cutting device for cutting the nap threads between a middle web and a first web and by a second cutting device for cutting the nap threads between the middle web and a second web in order thereby to obtain the middle web as a two-sided velvet ribbon.

6. The ribbon weaving machine as claimed in claim 5, characterized in that guides for the web, which are adjustable in the level and/or in the distance from one another, are arranged in each case at the cutting devices.

7. The ribbon weaving machine as claimed in claim 5, characterized in that the first and the second cutting device are arranged next to one another, and the first cutting device is assigned deflection means for returning the web to the second cutting device.

8. The ribbon weaving machine as claimed in claim 7, characterized in that a common cutting member is assigned to both cutting devices.

9. The ribbon weaving machine as claimed in claim 8, characterized in that the cutting member is designed as a cutting knife which is assigned a drive moving back and forth.

10. The ribbon weaving machine as claimed in claim 8, characterized in that the cutting member is designed as a rotating cutting band.

11. The ribbon weaving machine as claimed in claim 5, characterized in that the cutting member of the cutting device is assigned a grinding device.

12. The ribbon weaving machine as claimed in claim 5, characterized in that the cutting devices are assigned in each case a discharge device for discharging the separated web.

13. The ribbon weaving machine as claimed in claim 5, characterized in that it is designed as a needle ribbon weaving machine and has three weft insertion needles arranged one above the other.

14. A velvet ribbon has a nap on both sides, characterized in that it is produced by weaving and connecting three webs lying one above the other at a distance from one another to one another by means of nap threads, first severing the nap threads of the triple web thus produced in a first cutting device between the middle web and a first web, and then severing, in a second cutting device, the nap threads between the middle web and the second in order thereby to obtain the middle web as a two-sided velvet ribbon.

15. A velvet ribbon as claimed in claim 14, characterized in that it is produced on a needle ribbon weaving machine having three weaving stations lying one above the other and at a distance from one another, each with a weft insertion member and a common shedding device for opening three sheds and for laying nap threads connecting the weaving stations, in that the weaving stations are followed by the first cutting device for cutting the nap threads between the middle web and the first web and by the second cutting device for cutting the nap threads between the middle web and the second web.

16. A velvet ribbon as claimed in claim 14, characterized in that is produced on a needle ribbon weaving machine.

17. A velvet ribbon as claimed in claim 14, characterized in that it is produced by cutting the nap threads immediately after weaving on a ribbon weaving machine.

18. A velvet ribbon as claimed in claim 14, characterized in that the first and second cutting devices are arranged next to one another, and the web, once cut, is returned from the first cutting device to the second cutting device.

19. A velvet ribbon as claimed in claim 15, characterized in that the needle ribbon weaving machine includes guides for the web, which are adjustable in the level and/or in the distance from one another, and are arranged in each case at the cutting devices.

20. A velvet ribbon as claimed in claim 15, characterized in that the first and second cuffing device are arranged next to one another, and the first cutting device is assigned deflection means for returning the web to the second cutting device.

* * * * *